US008475290B2

(12) United States Patent
Yu et al.

(10) Patent No.: US 8,475,290 B2
(45) Date of Patent: Jul. 2, 2013

(54) GOLF TRAINING SYSTEM

(75) Inventors: Cheng-Chih Yu, New Taipei (TW); Kuo-Hui Chien, New Taipei (TW)

(73) Assignee: Kuo-Hui Chien, New Taipei (TW)

( * ) Notice: Subject to any disclaimer, the term of this patent is extended or adjusted under 35 U.S.C. 154(b) by 0 days.

(21) Appl. No.: 13/609,961

(22) Filed: Sep. 11, 2012

(65) Prior Publication Data

US 2013/0102406 A1 Apr. 25, 2013

(30) Foreign Application Priority Data

Oct. 24, 2011 (TW) ..... 100219933 U

(51) Int. Cl.
*A63B 69/36* (2006.01)

(52) U.S. Cl.
USPC ..... 473/278; 473/218; 473/257

(58) Field of Classification Search
USPC ..... 473/218, 219, 257, 260–266, 278, 473/279
See application file for complete search history.

(56) References Cited

U.S. PATENT DOCUMENTS

| | | | | |
|---|---|---|---|---|
| 4,736,952 | A * | 4/1988 | Taft et al. | 473/218 |
| 5,013,044 | A * | 5/1991 | Hesselbart | 473/218 |
| 5,255,921 | A * | 10/1993 | Spence | 473/218 |
| 6,582,319 | B2 * | 6/2003 | Czaja | 473/257 |
| 6,932,712 | B2 * | 8/2005 | Cardosi | 473/261 |
| 7,063,626 | B2 * | 6/2006 | Cardosi | 473/257 |
| 7,901,295 | B1 * | 3/2011 | Bush, III | 473/218 |

* cited by examiner

*Primary Examiner* — Nini Legesse
(74) *Attorney, Agent, or Firm* — Rosenberg, Klein & Lee

(57) ABSTRACT

A golf training system includes a wedge training aid adapted to help the user control the hitting range of each wedge accurately so that the user can drive the ball to the green easily for putting into the hole when playing a golf game at a golf course. The golf training system further includes a putting green training aid, a mat arranged between the wedge training aid and the putting green training aid, a ball collector arranged at the rear side of the wedge training aid, a track connected between the putting green training aid and the ball collector, and a guard net mounted at the putting green training aid. Thus, each ball been hit onto the putting green training aid or intercepted by the guard net can be collected by the ball collector for a next hitting practice.

15 Claims, 9 Drawing Sheets

GOLF TRAINING SYSTEM

BACKGROUND OF THE INVENTION

1. Field of the Invention

The present invention relates to a golf training aids and more particularly, to a golf training system, which helps control of the hitting range of each wedge and provides an automatic ball retrieving function.

2. Description of the Related Art

Among the 14 golf clubs of a standard set, the wedges are important golf clubs designed for special use situations to aid the player in making accurate short-distance shots, to get the ball onto the green or out of a hazard or other tricky spot. Driving the ball closer to the hole increases the chance to put the ball into the hole. Wedges can make chance to enable the ball be put into the hole easily. Even if your driving distance is always farther than your playing partners, you still cannot drive the ball onto the green in two strokes for each par-5 hole. However, if you have a reliable and steady wedge technique, you still can make a birdie chance. The key lies in the precise control of the hitting distance. The structure of a wedge enables you to hit the ball to different distances subject to different conditions. The loft angle of the wedge determines the hitting distance.

Most golf players will carry three wedges, one small angle wedge, one sand wedge and one large angle wedge, having a loft of about 52°, 60° and 60° respectively. But, as the climate ever-changing, a golf player may carry a different combination of golf clubs for each different golf game subject to the characteristics of the golf course.

After understanding of the combination of a golf club set, the next step is to practice. The only way to improve the wedge technique is to keep practicing. The use of a proper training system can get double the effect. However, no any simple and effective wedge training aid that can aid a user to accurately control the wedge hitting range is commercially available. A beginner can only rely on the guidance of a coach or practice wedges subject to golf textbooks, the result is always less effective.

SUMMARY OF THE INVENTION

It is therefore the main object of the present invention to provide a golf training system, which comprises a wedge training aid comprising a base, a horizontal bar axially slidably inserted into a sliding rail at the base, a height-adjustable upright bar hinged to the horizontal bar and an elevation marker mounted at the upright bar at a selected elevation corresponding to a predetermined wedge finish to help the user control the hitting range of each wedge accurately so that the user can drive the ball to the green easily for putting into the hole when playing a golf game at a golf course.

It is another object of the present invention to provide a golf training system, which further comprises a putting green training aid, a mat arranged between the wedge training aid and the putting green training aid, a ball collector arranged at the rear side of the wedge training aid, a track connected between the putting green training aid and the ball collector, and a guard net mounted at the putting green training aid. Thus, each ball been hit onto the putting green training aid or intercepted by the guard net can be collected by the ball collector for a next hitting practice.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
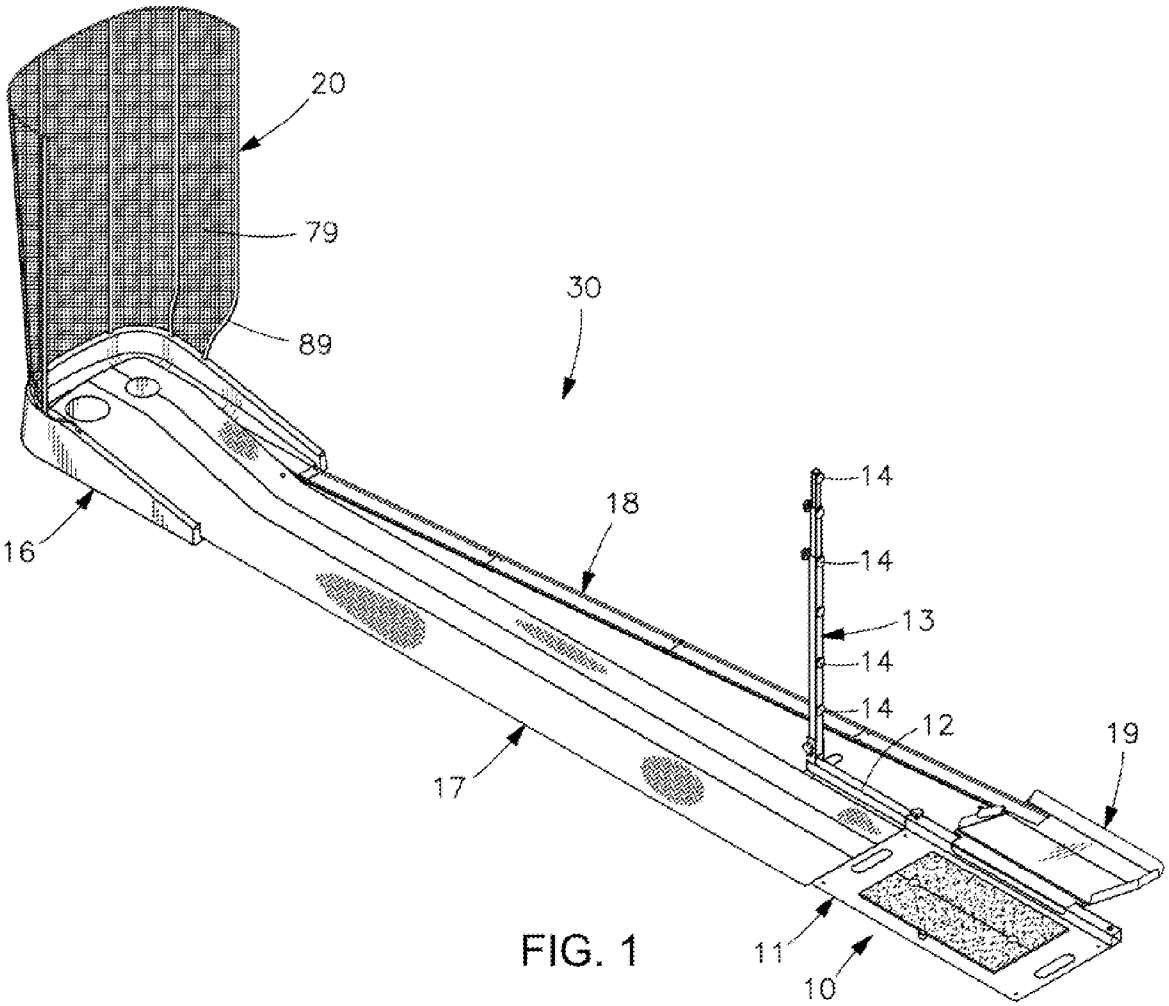
FIG. 1 is an elevational view of a golf training system in accordance with the present invention.

Referring to FIG. 1, a golf training system 30 in accordance with the present invention is shown. The golf training system 30 comprises a wedge training aid 10, a putting green training aid 16, a mat 17, a track 18, a ball collector 19, and a guard net 20.

Figure 2:
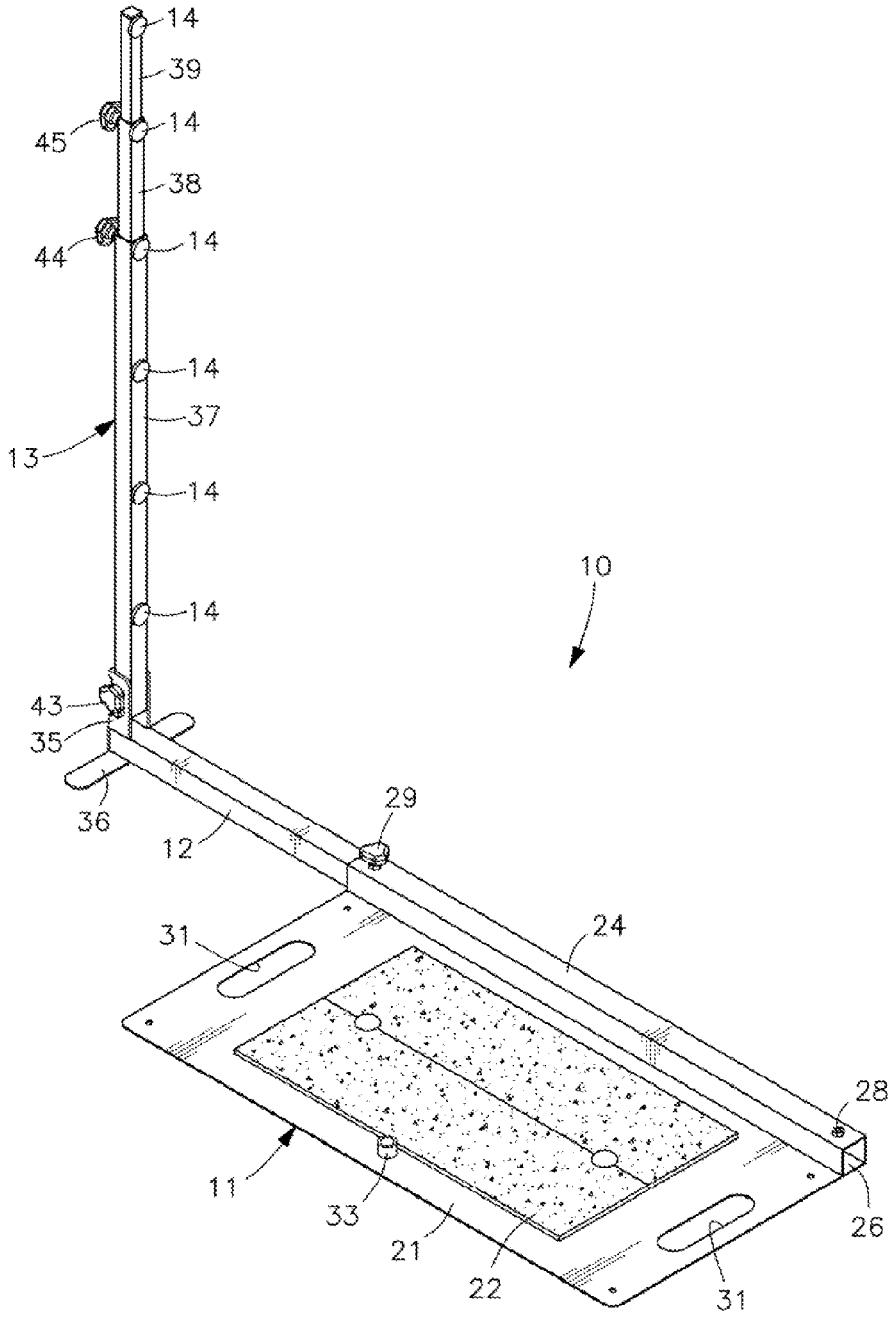
FIG. 2 is an elevational view of the wedge training aid of the golf training system in accordance with the present invention.
Figure 3:
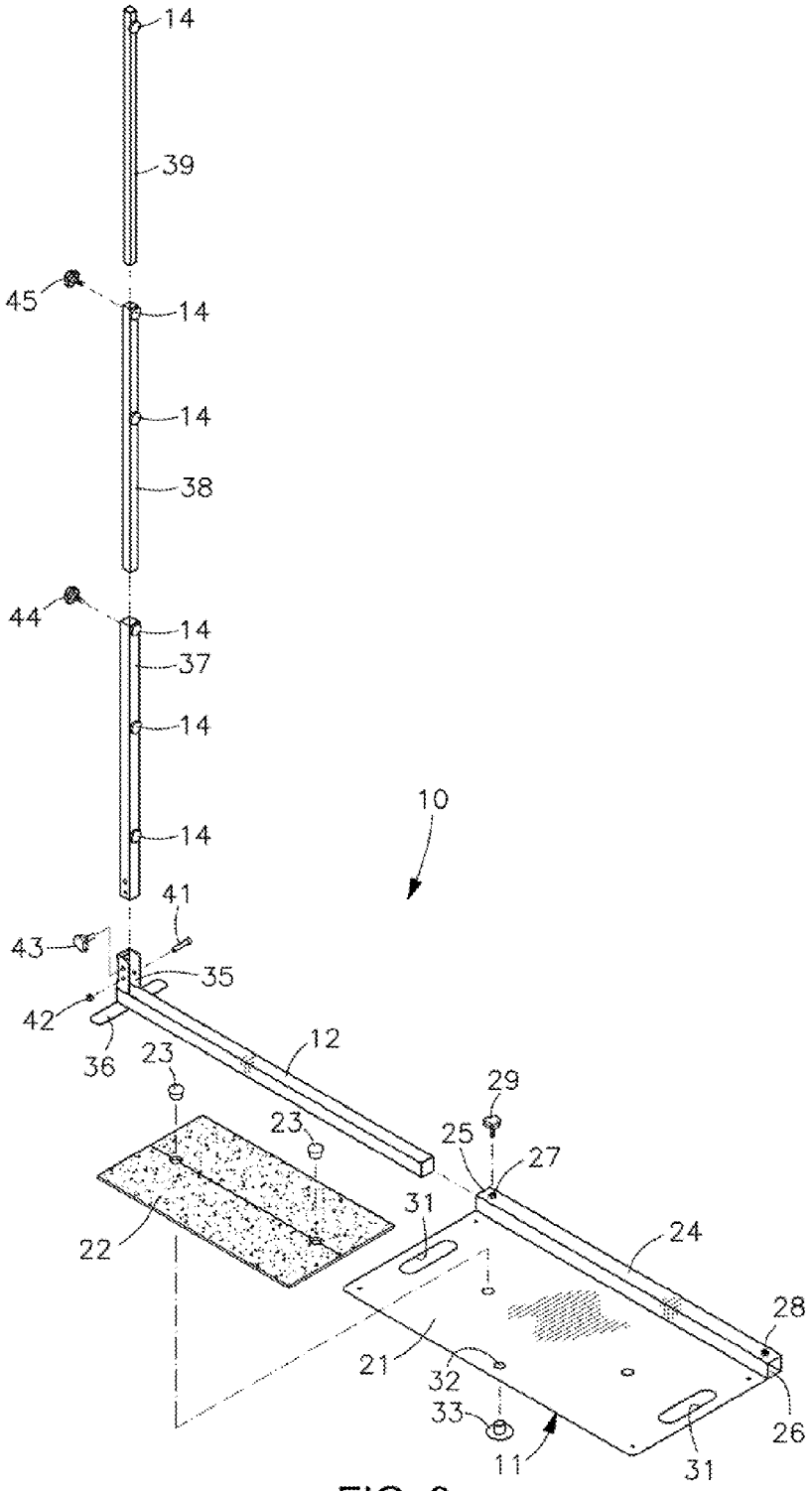
FIG. 3 is an exploded view of the wedge training aid shown in FIG. 2.

Referring to FIGS. 2 and 3, the wedge training aid 10 comprises a base 11, a horizontal bar 12, an upright bar 13, and elevation markers 14.

Figure 5:
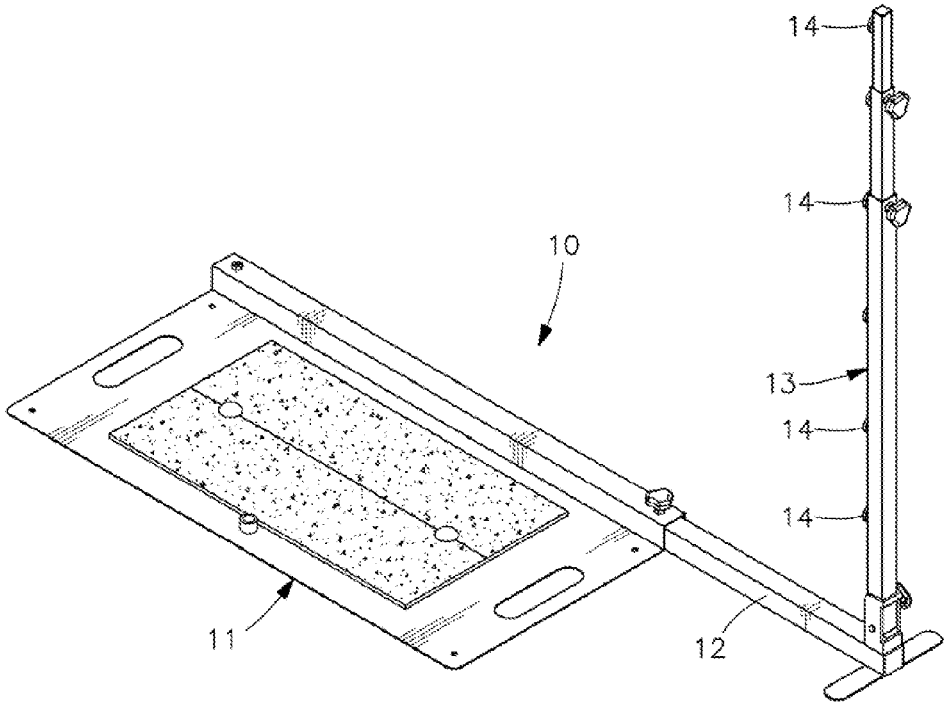
FIG. 5 corresponds to FIG. 2 when viewed from the reversed direction.

The base 11 comprises a rectangular bottom plate 21 configured to ensure maximum stability of the base 11, a pad 22 made by an non-slip material, such as artificial turf, synthetic fibers or the like, and positioned on the top surface of the bottom plate 21 for holding a golf ball thereon positively in position, a pair of fasteners 23 (or adhesive) to affix the pad 22 to the bottom plate 21 and to prevent displacement of the pad 22 relative to the bottom plate 21, and a sliding rail 24 affixed to a rear side of the bottom plate 21. The sliding rail 24 is form of a rectangular tube defining opposing left opening 25 and right opening 26 for the insertion of the horizontal bar 12 into the inside of the sliding rail 24 selectively to fit a right-handed player (see FIG. 2) or a left-handed player (see FIG. 5), and having a left-handed nut 27 and a right-handed nut 28 respectively disposed near the two opposite ends thereof for the mounting of a manually operable fastener, for example, handle screw 29.

Preferably, the base 11 provides two oblong slots 31 located on the bottom plate 21 near its two opposite ends. These oblong slots 31 facilitate hand carrying and allow positioning of a directional golf ball during practice. The base 11 further comprises a mounting hole 32 disposed near the front side thereof for the mounting of a target 33. The target 33 is stepped member made of an elastic material, for example, synthetic or natural rubber, having a relatively greater lower part pressed under the bottom plate 21 and a relatively smaller upper part inserted through the mounting hole 32 and protruded over the top side of the bottom plate 21 for practicing the golf swing.

The horizontal bar 12 is form of a rectangular tube, axially slidably inserted into the sliding rail 24 and locked thereto by the manually operable fastener 29. The horizontal bar 12 comprises an upright lug 35 perpendicularly upwardly extended from its front end to which the upright bar 13 is pivotally connected, and two wing plates 36 extended from the bottom wall of its front end in reversed direction to enhance positioning stability.

The upright bar 13 is a retractable bar consisting of multiple parts, allowing adjustment of the length (height) and facilitating carrying and storage. In this embodiment, the upright bar 13 comprises an outer tube member 37 pivotally connected to the upright lug 35 of the horizontal bar 12 by a screw 41 and a nut 42 and lockable thereto in vertical by a manually operable fastener, for example, handle screw 43, an intermediate tube member 38 axially slidably inserted into the outer tube member 37 and lockable thereto by a manually operable fastener, for example, handle screw 44 at the outer tube member 37, and an inner tube member 39 axially slidably inserted into the intermediate tube member 38 and lockable thereto by a manually operable fastener, for example, handle screw 45 at the intermediate tube member 38. However, it is to be understood that any other designs that allow free adjustment of the height of the upright bar 13 can be selectively used to substitute for the aforesaid arrangement without departing from the spirit and scope of the invention. Further, in the case that the ease of storage and carrying is not considered, the upright bar 13 can be made of one-piece rod member that does not allow adjustment of the height.

Figure 2A:
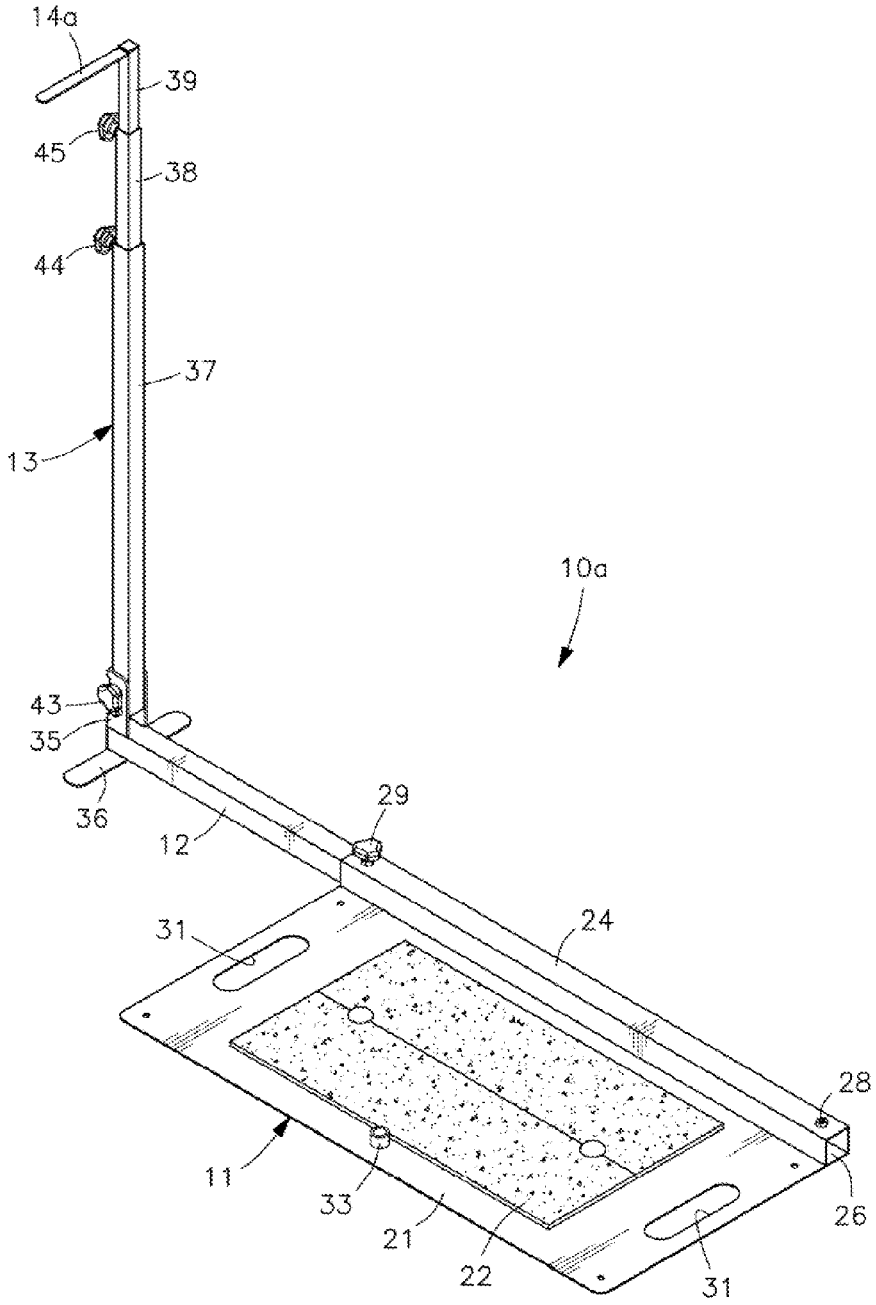
FIG. 2A is similar to FIG. 2, illustrating an alternate form of the wedge training aid.

The elevation markers 14 in this embodiment are differently colored magnets selectively attachable to the upright bar 13 at different elevations by magnetic attraction to mark the height for wedge finish during practice, enabling the user to accurately control the wedge hitting range at different wedge finishes. However, the elevation markers 14 are not limited to magnets. Alternatively, the wedge training aid 10*a* shown in FIG. 2A uses a rod member horizontally connected to the top end of the upright bar 13 to work as an elevation marker 14*a*. The embodiment shown in FIG. 2A is same as that shown in FIGS. 1 and 2 with the exception of the elevation marker 14*a*.

Figure 4:
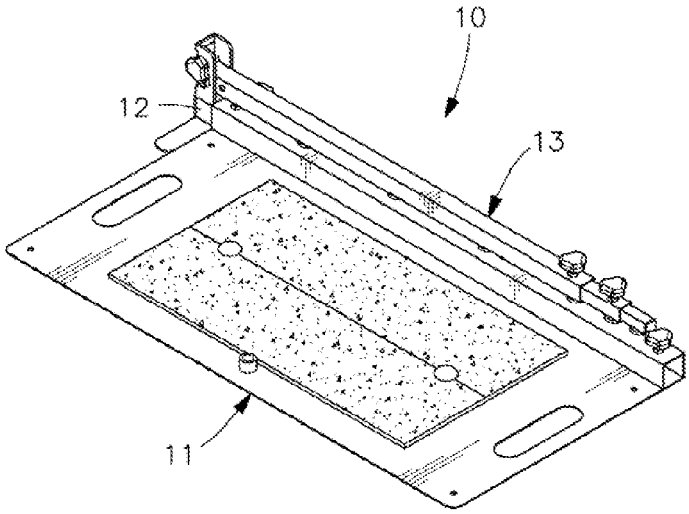
FIG. 4 illustrates a received status of the wedge training aid shown in FIG. 2.

FIG. 4 illustrates a received condition of the wedge training aid 10. When receiving wedge training aid 10, put the horizontal bar 12 into the inside of the sliding rail 24 and lock it in the received position, and then adjust the upright bar 13 to the lowest height and lock it in the adjusted position, and then turn the upright bar 13 from vertical to horizontal where the upright bar 13 is kept attached to the sliding rail 24, convenient for carrying and storage.

Figure 6A:
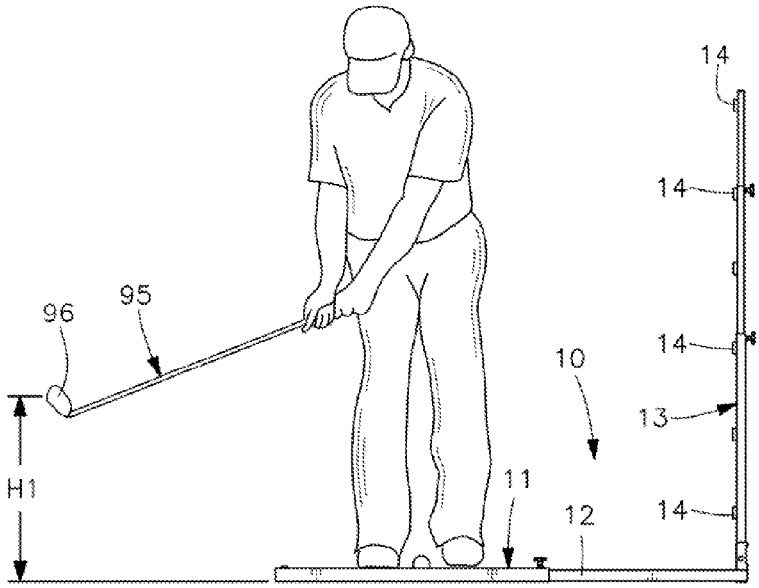
FIG. 6A is a schematic drawing of the present invention, illustrating a status of use of the wedge training aid (I).
Figure 6B:
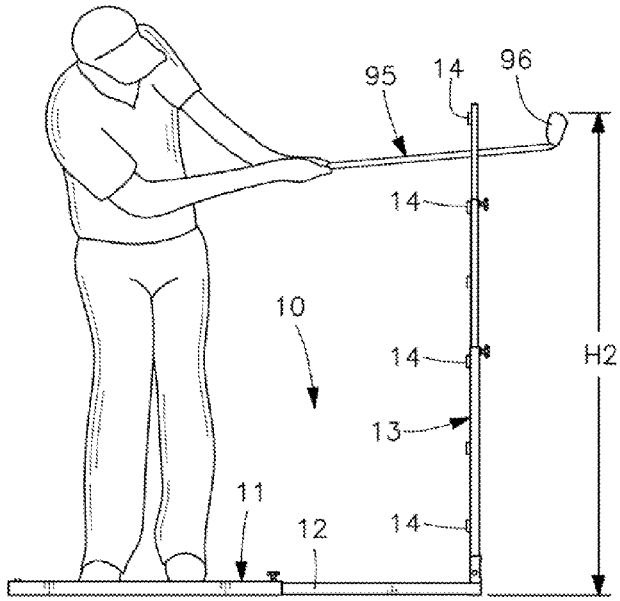
FIG. 6B is a schematic drawing of the present invention, illustrating a status of use of the wedge training aid (II).

When using the wedge training aid 10, as shown in FIGS. 6A and 68, pull the horizontal bar 12 out of the sliding rail 24 and lock it in the extended position, and then lift the upright bar 13 from horizontal to vertical and lock it in the vertical position, and then adjust the height of the upright bar 13 to the maximum and then lock it in position, and then attach the elevation markers (differently colored magnets) 14 to the upright bar 13 at 5 feet height and other elevations subject to expected wedge finishes the wedge 95 to be practiced, for example, 2:5 golf swing (2 means the ground clearance H1 between the head 96 of the wedge 95 and the ground during the backswing to be 2 feet; 5 means the ground clearance H2 between the head 96 of the wedge 95 and the ground during the finish to be 5 feet; other golf swings such as 1:3, 1:4, 1:5, 2:3, or 2:4 may be employed). Thereafter, place the golf ball 97 on the pad 22 of the base 11, and then aim the head 96 of the wedge 95 at the golf ball 97 to practice the backswing, swinging the wedge 95 backwardly to the position where the head 96 of the wedge 95 reaches the position about 2 feet high from the ground (H1=2 feet, as shown in FIG. 6A) and then drive out the golf ball 97 to the extent where the head 96 of the wedge 95 is kept about the elevation of the elevation marker 14 (height H2 of finish=5 feet, as shown in FIG. 6B). Practice 10 times for every swing and remember the average hitting range till that every wedge has been trained. After a certain period of training, the player can accurately know the hitting range of every wedge under every different golf swing, and then find the most reliable and the most confident offensive distance, enabling every pitch shot to be closer to the hole.

In case only one elevation marker (magnet) 14 is used, or in the case that a rod member horizontally connected to the top end of the upright bar 13 to work as an elevation marker 14*a*, adjust the elevational position of the elevation marker 14 at the upright bar 13, or adjust the height (length) of the upright bar 13 to change the elevation of the elevation marker 14*a* subject to different golf swings for practicing different finishes.

The aforesaid training methods are only suggestions but not restrictions. The user can adjust the training procedures subject to personal habits or preferences, until full learning of the skills to use the wedges to hit different distances.

Figure 7:
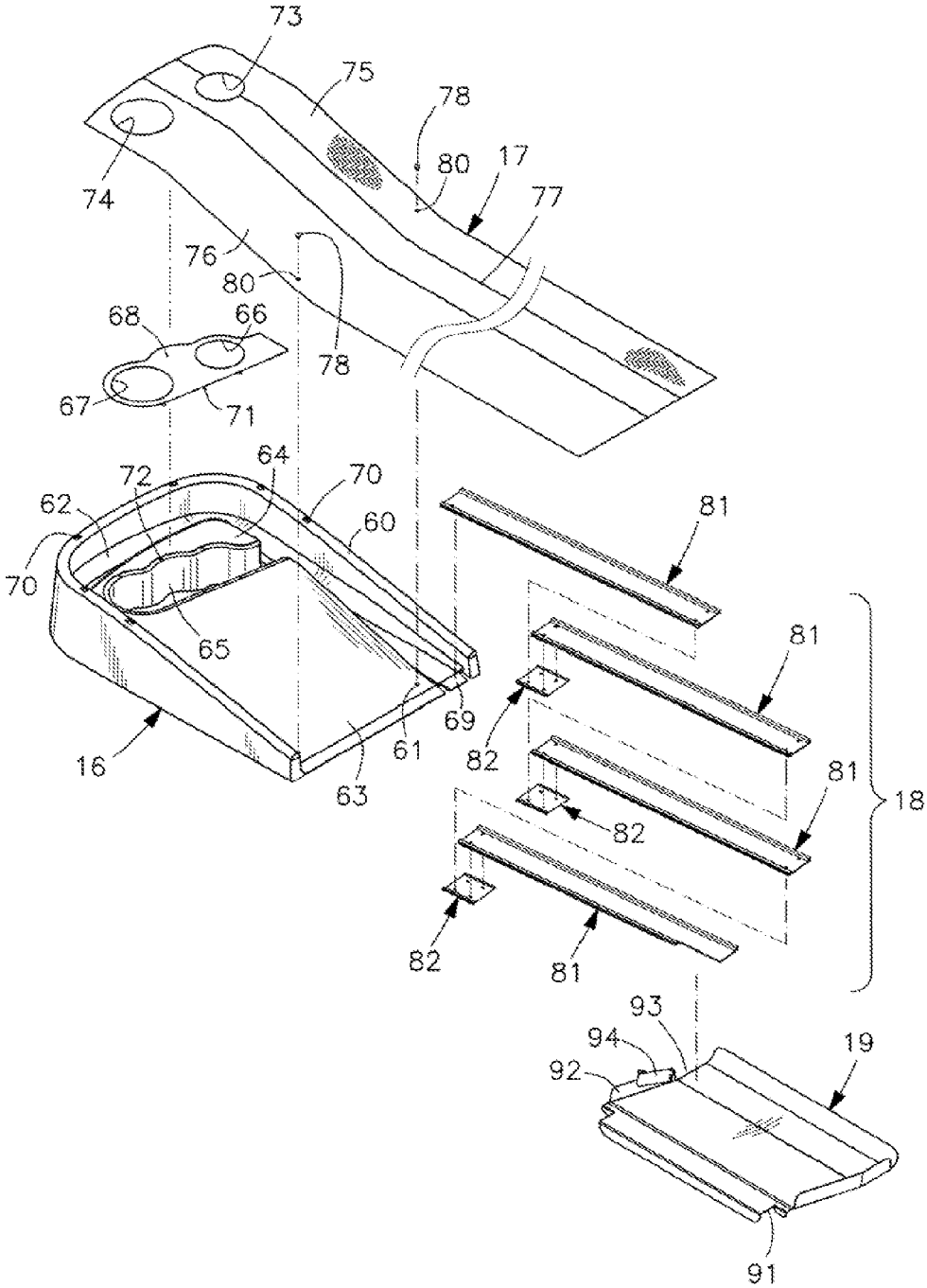
FIG. 7 is an exploded view of a part of the present invention, illustrating the structure of the putting green training aid and the guard net.
Figure 7A:
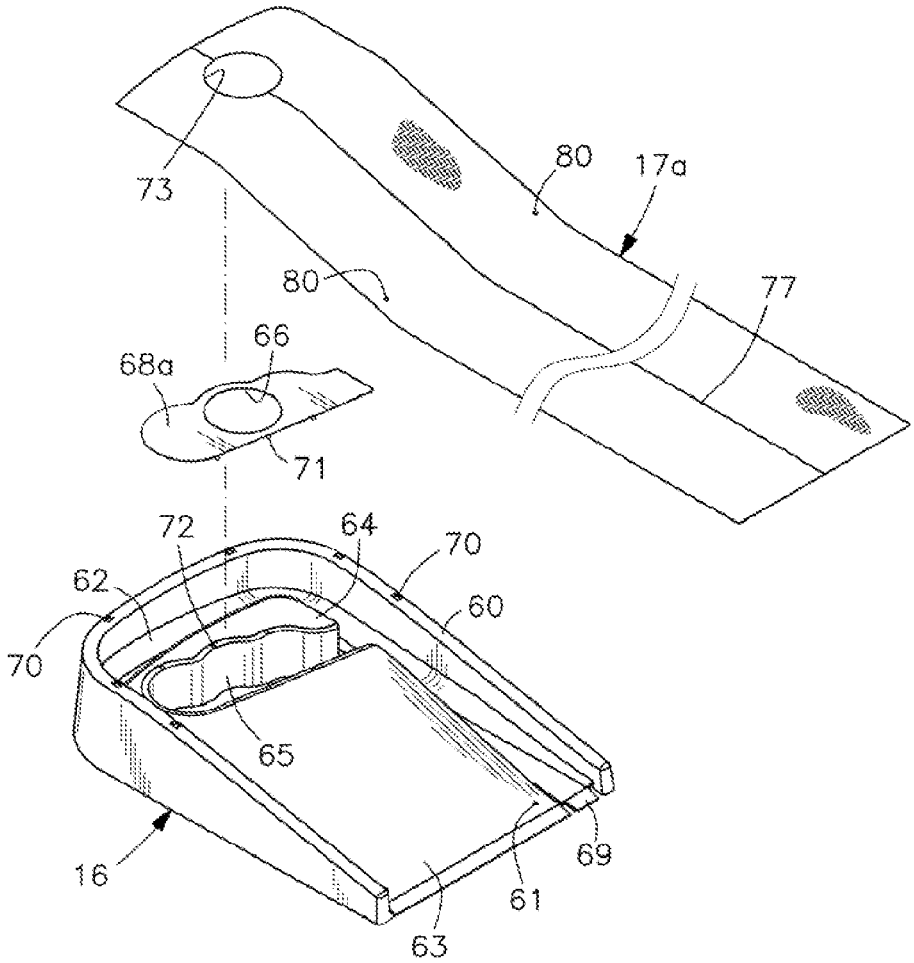
FIG. 7A is an exploded view of an alternate form of the putting green training aid in accordance with the present invention.

Referring to FIG. 7 and FIG. 1 again, the putting green training aid 16 comprises a slope 63, a highland 64, an inverted-U fence 60 surrounding the slope 63 and the highland 64, a inverted-L guide groove 62 extending along the inner side of the fence 60, a ditch 65 located on the highland 64 in communication with the inverted-L guide groove 62, a ditch cover 68 covering the ditch 66 and defining therein a first hole 66 and a second hole 67 for allowing the ball falling into the first hole 66 or second hole 67 to be guided by the ditch 65 and the inverted-L guide groove 62 to the track 18, a plug plate 69 extended from the distal end of the inverted-L guide groove 62 for the connection of the track 18, and a plurality of pins 71 downwardly extended from the border of the bottom wall of the ditch cover 68 and respectively plugged into respective pinholes 72 at the highland 64 to detachably secure the ditch cover 68 to the highland 64. FIG. 7A illustrates a substitute ditch cover 68*a* that has only the first hole 66.

Referring to FIGS. 1 and 7 again, the mat 17 is an elongated strip member made of artificial turf, synthetic fibers, or any other material similar to the green surface structure, having its one end connected to the bottom plate 21 of the base 11 and its other end provided with two locating holes 80 for the insertion of two fasteners 78 into two locating holes 61 at the slope 63 of the putting green training aid 16 to secure the mat 17 to the slope 63 and the highland 64. The mat 17 defines a first hole 73 and a second hole 74 corresponding to the first hole 66 and second hole 67 of the ditch cover 68 respectively. Further, the mat 17 divided into a first area 75 and a second area 76 that are respectively colored with two different colors. The first hole 73 is located on the first area 75. The second hole 74 is located on the second area 76. Further, the first area 76 carries a line mark 77 that extends straightly from one end of the mat 17 across the first hole 73 to the other end of the mat 17 for reference to check the rolling track of the ball. The mat 17*a* shown in FIG. 7A provides only the first hole 73 to match the ditch cover 68*a* that provides only the first hole 66.

Figure 8:
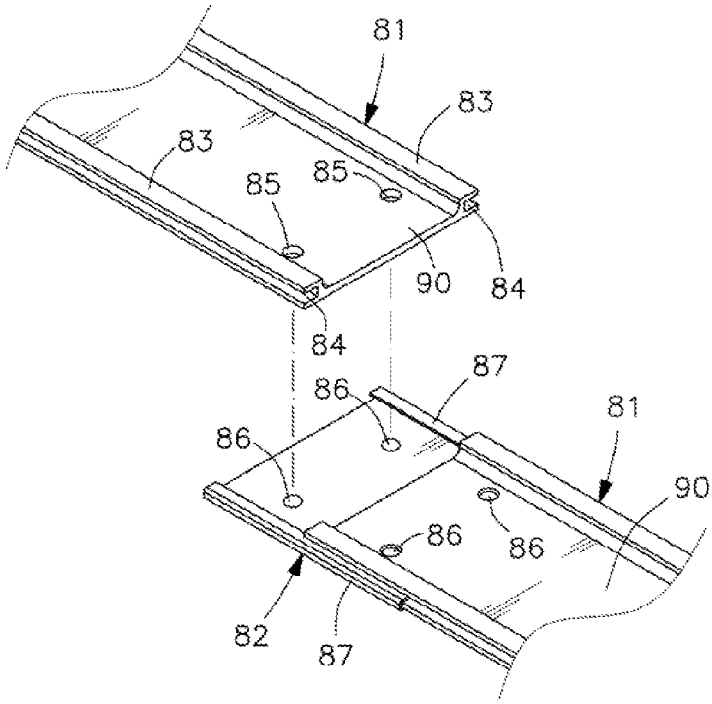
FIG. 8 is a schematic exploded view of a part of the present invention, illustrating the mounting structure of the track between two rails and one connector.
Figure 9:
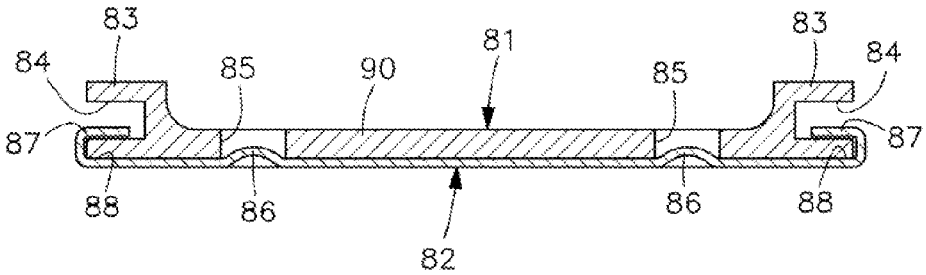
FIG. 9 is a cross sectional view of a part of the present invention, illustrating the mounting structure of the track.

Referring to FIGS. 8 and 9 and FIGS. 1 and 7 again, the track 18 comprises four rails 81 and three connectors 82 respectively connected between each two rails 81. One end of the track 18 is connected to the guide groove 62 of the putting green training aid 16. The other end of the track 18 is supported on the ball collector 19. Each rail 81 comprises a narrow elongated flat rail base 90, two side flanges 83 respectively extending along two opposite lateral sides of the flat rail base 90, a longitudinal groove 84 defined in and extending along the length of each side flange 83, and two dowel holes 85 on each of the two ends thereof. The aforesaid plug plate 69 is press-fitted into one rail 81 between the side flanges 83. The connectors 82 are rectangular plate members, each comprising four dowels 86 upwardly extended from the top wall thereof in the four corners, two coupling flanges 87 respectively upwardly extended from the two opposite lateral sides thereof and then turned horizontally inwards, and a coupling groove 88 defined in each of the coupling flange 87. When connecting each two rails 81, insert the respective ends of the rails 81 into one connector 82 to couple the respective side flanges 83 to the respective coupling flanges 87 and engage the respective dowels 86 into respective dowel holes 85. Subject to this mounting arrangement, the rails 81 are connected in series. Further, the number of the rails 81 can be changed subject to the dimension of the training field. Further, the coupling structure between each two rails 81 is not limited to the aforesaid arrangement. For example, dovetail joint or T-shaped tongue-and-groove joint can be used as a substitute.

Referring to FIGS. 1 and 7 again, the ball collector 18 is adapted to collect the golf ball, comprising a sidewall 92, a channel 91 defined in a front side of the sidewall 92 and attached to sliding rail 24 of the base 11 on the floor to let the collector 19 be affixed to the rear side of the base 11, and a notch 93 located on the left side of the sidewall 92. The track 18 is extended through the notch 93 to the top side of the ball collector 19 for enabling the driven ball to roll along the track 18 into the ball connector 19, avoiding the inconvenience of retrieving balls and improving practice efficiency. When the track 18 is not in use, the gate 94 that is hinged to the sidewall 92 can be moved to block the notch 93, prohibiting the golf ball from running out of the ball collector 19 through this notch 93.

As shown in FIG. 1, the guard net 20 comprises a net 79 and a net rack 89. The net rack 89 comprises a plurality of posts (no reference number) respectively plugged into respective plugholes 70 of the fence 60 (see FIG. 7), to detachably secure the guard net 20 to the putting green training aid 16. The net 79 is hung on the net rack 89 to intercept the golf ball that flies over the putting green training aid 16, enabling the golf ball to fall to the putting green training aid 16 and then to roll along the guide groove 62 and the track 18 to the ball collector 19.

Further, the wedge training aid 10 of the golf training system 30 can be used independently, or assembled with the putting green training aid 16, the mat 17, the track 18, the ball collector 19 and the guard net 20 for application.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A golf training system, comprising a wedge training aid, said wedge training aid comprising:

a base comprising a bottom plate and a sliding rail arranged at a rear side of said bottom plate;

a horizontal bar axially slidably inserted into said sliding rail and lockable thereto by a fastener thereof;

an upright bar comprising opposing bottom end and top end, the bottom end of said upright bar being pivotally connected to said horizontal bar and lockable thereto by a fastener thereof; and elevation marker means adjustably mounted at said upright bar at a selected elevation corresponding to a predetermined wedge finish.

2. The golf training system as claimed in claim 1, wherein said upright bar of said wedge training aid is a retractable bar, comprising a plurality of ferrous metal tubes slidably inserted one inside another and fastener means for locking said tubes; said elevation marker means comprises a plurality of magnets having different colors.

3. The golf training system as claimed in claim 1, wherein said upright bar of said wedge training aid is a retractable bar, comprising a plurality of ferrous metal tubes slidably inserted one inside another and fastener means for locking said tubes; said elevation marker means is a magnet.

4. The golf training system as claimed in claim 1, wherein said upright bar of said wedge training aid is a retractable bar, comprising a plurality of tubes slidably inserted one inside another and fastener means for locking said tubes; said elevation marker means is a rod member horizontally affixed to the top end of said upright bar.

5. The golf training system as claimed in claim 1, wherein said base of said wedge training aid further comprises a pad affixed to a top surface of said bottom plate.

6. The golf training system as claimed in claim 1, wherein said sliding rail of said wedge training aid comprises opposing left opening and right opening for the insertion of said horizontal bar into said sliding rail selectively.

7. The golf training system as claimed in claim 1, wherein said base of said wedge training aid further comprises two oblong slots respectively located on two opposite ends of said bottom plate.

8. The golf training system as claimed in claim 1, wherein said wedge training aid further comprises a target made of an elastic material and mounted at said bottom plate of said base.

9. The golf training system as claimed in claim 8, wherein said base of said wedge training aid further comprises a mounting hole located on said bottom plate; said target is a stepped member having a relatively larger lower part held under said bottom plate and a relatively smaller upper part inserted through said mounting hole and protruding over said bottom plate.

10. The golf training system as claimed in claim 1, further comprising:

a putting green training aid comprising a lope, a highland, a fence surrounding said slope and said highland, a guide groove extending along an inner side of said fence, a ditch disposed at said highland in communication with said guide groove, and a ditch cover covering said ditch, said ditch cover defining at least one ball hole;

a track having one end thereof connected to said guide groove of said putting green training aid and an opposite end thereof extending to a rear side of said base;

a guard net comprising a net rack mounted at said fence of said putting green training aid and a net hung on said net rack; and a mat having one end thereof connected to said bottom plate of said base and an opposite end thereof covered on said slope and said highland of said putting green training aid, said mat comprising at least one hole respectively kept in vertical alignment with said at least one ball hole of said putting green training aid.

11. The golf training system as claimed in claim 10, further comprising a ball collector, said ball collector comprising a sidewall, a channel defined in a front side of said sidewall for attaching to said sliding rail of said base, and a notch disposed at a left side of said sidewall for enabling said track to be extended to a top side of said ball collector.

12. The golf training system as claimed in claim 11, wherein said ball collector further comprises a gate hinged to said sidewall and adapted to block said notch.

13. The golf training system as claimed in claim 10, wherein said track comprises a plurality of rails and a plurality of connectors for connecting said rails in a line.

14. The golf training system as claimed in claim 13, wherein each rail of said track comprises a flat rail base, two side flanges respectively extending along two opposite lateral sides of said flat rail base, a longitudinal groove defined in and extending along the length of each said side flange, and two dowel holes on each of two ends thereof; said connectors are rectangular plate members, each comprising four dowels upwardly extended from a top wall thereof in four corners, two coupling flanges respectively upwardly extended from two opposite lateral sides thereof and a coupling groove defined in each said coupling flange.

15. The golf training system as claimed in claim 14, wherein said putting green training aid comprises a plug plate extended from a distal end of said guide groove and press-fitted into one rail of said track between the side flanges of the rail.

* * * * *